US007836980B2

(12) United States Patent
Stevens et al.

(10) Patent No.: US 7,836,980 B2
(45) Date of Patent: Nov. 23, 2010

(54) EARTH-BORING TOOLS HAVING POCKETS FOR RECEIVING CUTTING ELEMENTS AND METHODS FOR FORMING EARTH-BORING TOOLS INCLUDING SUCH POCKETS

(75) Inventors: John H. Stevens, Spring, TX (US); Nicholas J. Lyons, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 329 days.

(21) Appl. No.: 11/838,008

(22) Filed: Aug. 13, 2007

(65) Prior Publication Data

US 2009/0044663 A1 Feb. 19, 2009

(51) Int. Cl.
*E21B 10/00* (2006.01)
*E21B 10/36* (2006.01)

(52) U.S. Cl. ..... 175/432; 175/398; 175/383

(58) Field of Classification Search ..... 175/374, 175/398, 78, 259, 334, 371, 108.2, 432, 383, 175/428; 299/109, 111, 113
See application file for complete search history.

(56) References Cited

U.S. PATENT DOCUMENTS 4,511,006 A * 4/1985 Grainger ..... 175/57
5,111,895 A * 5/1992 Griffin ..... 175/425
5,558,170 A 9/1996 Thigpen et al.
5,829,539 A 11/1998 Newton et al.
5,906,245 A * 5/1999 Tibbitts et al. ..... 175/426
6,234,261 B1 5/2001 Evans et al.
6,349,780 B1 2/2002 Beuershausen
7,070,011 B2 * 7/2006 Sherwood et al. ..... 175/432
2006/0185908 A1 8/2006 Kambaiyan et al.
2007/0056777 A1 3/2007 Overstreet
2007/0102198 A1 5/2007 Oxford et al.
2007/0102199 A1 5/2007 Smith et al.

OTHER PUBLICATIONS

PCT International Search Report for International Application No. PCT/US2008/072998, mailed Jan. 5, 2009.
U.S. Appl. No. 11/717,905, filed Mar. 13, 2007, entitled "Earth-Boring Tools Having Pockets for Receiving Cutting Elements Therein and Methods of Forming Such Pockets and Earth-Boring Tools."

* cited by examiner

*Primary Examiner*—David J Bagnell
*Assistant Examiner*—Yong-Suk Ro
(74) *Attorney, Agent, or Firm*—TraskBritt

(57) ABSTRACT

Methods of forming cutting element pockets in blades of earth-boring tools include forming a first recess and a second recess intersecting at a location defining the a back of the pocket using a cutter oriented in a manner so as to avoid tool path interference with adjacent blades. A filler material is disposed in the second recess to the location of the back of the pocket. Earth-boring tools including such cutting element pockets.

20 Claims, 12 Drawing Sheets

EARTH-BORING TOOLS HAVING POCKETS FOR RECEIVING CUTTING ELEMENTS AND METHODS FOR FORMING EARTH-BORING TOOLS INCLUDING SUCH POCKETS

FIELD OF THE INVENTION

The present invention relates generally to earth-boring tools and methods of forming earth-boring tools. More particularly, embodiments of the present invention relate to methods of securing cutting elements to earth-boring tools and to tools formed using such methods.

BACKGROUND

Rotary drill bits are commonly used for drilling bore holes or wells in earth formations. One type of rotary drill bit is the fixed-cutter bit (often referred to as a "drag" bit), which typically includes a plurality of cutting elements secured to a face region of a bit body. Referring to FIG. 1, a conventional fixed-cutter earth-boring rotary drill bit 100 includes a bit body 102 that has generally radially projecting and longitudinally extending wings or blades 104, which are separated by junk slots 106.

A plurality of cutting elements 108 is positioned on each of the blades 104. Generally, the cutting elements 108 have either a disk shape or, in some instances, a more elongated, substantially cylindrical shape. The cutting elements 108 commonly comprise a "table" of super-abrasive material, such as mutually bound particles of polycrystalline diamond, formed on a supporting substrate of a hard material, conventionally cemented tungsten carbide. Such cutting elements are often referred to as "polycrystalline diamond compact" (PDC) cutting elements or cutters. The plurality of PDC cutting elements 108 may be provided within cutting element pockets 110 formed in rotationally leading surfaces of each of the blades 104. The PDC cutting elements 108 may be supported from behind (taken in the direction of bit rotation) by buttresses 112, which may be integrally formed with the bit body 102. Conventionally, a bonding material such as an adhesive or, more typically, a braze alloy may be used to secure the cutting elements 108 to the bit body 102.

The bit body 102 of a rotary drill bit 100 typically is secured to a hardened steel shank having an American Petroleum Institute (API) thread connection 114 for attaching the drill bit 100 to a drill string (not shown). The drill string includes tubular pipe and component segments coupled end to end between the drill bit and other drilling equipment at the surface. Equipment such as a rotary table or top drive may be used for rotating the drill string and the drill bit within the bore hole. Alternatively, the shank of the drill bit may be coupled to the drive shaft of a down-hole motor, which then may be used to rotate the drill bit, alone or in combination with rotation of the drill string from the surface.

During drilling operations, the drill bit 100 is positioned at the bottom of a well bore hole and rotated. Drilling fluid is pumped through the inside of the bit body 102, and out through the nozzles 116. As the drill bit 100 is rotated, the PDC cutting elements 108 scrape across and shear away the underlying earth formation material. The formation cuttings mix with the drilling fluid and pass through the junk slots 106, up through an annular space between the wall of the bore hole and the outer surface of the drill string to the surface of the earth formation.

The bit body 102 of a fixed-cutter rotary drill bit 100 may be formed from steel. Such steel bit bodies are typically fabricated by machining a steel blank (using conventional machining processes including, for example, turning, milling, and drilling) to form the blades 104, junk slots 106, pockets 110, buttresses 112, and other features of the drill bit 100.

As previously described, the cutting elements 108 of an earth-boring rotary drill bit often have a generally cylindrical shape. Therefore, to form a pocket 110 for receiving such a cutting element 108 therein, it may be necessary or desirable to form a recess into the body of a drill bit that has the shape of a flat-ended, right cylinder. Such a recess may be machined into the body of a drill bit by, for example, using a drilling or milling machine to plunge a rotating flat-bottomed end mill cutter into the body of a drill bit along the axis of rotation of the cutter. Such a machining operation may yield a cutting element pocket 110 having a substantially cylindrical surface and a substantially planar inner end surface for disposing and brazing a generally cylindrical cutting element 108 therein.

In some situations, however, difficulties may arise in machining such generally cylindrical cutting element pockets. For instance, there may be physical interference between the machining equipment used, such as a multiple-axis milling machine, and the blades of the drill bit adjacent to the blade on which it is desired to machine a cutting element pocket. This is particularly true when cutting element pockets are to be formed in the center, or "cone" region, of the bit face. As illustrated in FIG. 2, attempting to machine a cutting element pocket in blade 204 at a low angle and in the direction of the arrow may not be possible because of interference with blade 206. More specifically, the interference caused by blade 206 may inhibit the use of a desired machining path for a machining tool that is aligned generally along the axis of rotation thereof because at least one of the machining tool and the collet or chuck that retains the machining tool may contact adjacent blade 206. As a result, in order to form the desired cutting element pocket by way of a flat-bottomed machining tool, such as an end mill, the machining tool may be required to remove a portion of adjacent blade 206.

As a result of such tool path interference problems, it may be necessary to orient one or more cutting element pockets on the face of an earth-boring rotary drill bit at an angle that causes the cutting element secured therein to exhibit a back rake angle that is greater than a desired back rake angle. A lower, or more aggressive, back rake angle than that conventionally obtainable using the foregoing machining technique may be preferred to improve the rate of penetration while drilling.

Methods for overcoming such tool path interference problems have been presented in the art. For example, U.S. Pat. No. 7,070,011 to Sherwood, Jr., et al. discloses steel body rotary drill bits having primary cutting elements that are disposed in cutter pocket recesses that are partially defined by cutter support elements. The support elements are affixed to the steel body during fabrication of the drill bits. At least a portion of the body of each cutting element is secured to a surface of the steel bit body, and at least another portion of the body of each cutting element matingly engages a surface of one of the support elements.

However, there is a continuing need in the art for methods of forming cutting element pockets on earth-boring rotary drill bits that avoid the tool path interference problems discussed above and that do not require use of additional support elements.

BRIEF SUMMARY OF THE INVENTION

In some embodiments, the present invention includes methods of forming one or more cutting element pockets in a surface of an earth-boring tool such as, for example, a fixed cutter rotary drill bit, a roller cone rotary drill bit, a core bit, an eccentric bit, a bicenter bit, a reamer, or a mill. The methods include using a rotating cutter to machine a cutting element pocket in such a way as to avoid mechanical tool interference problems and forming the pocket so as to sufficiently support a cutting element therein. For example, methods of the present invention may include machining a first recess in a bit body of an earth-boring tool to define a lateral sidewall surface of a cutting element pocket. A second recess may be machined in the bit body to define at least a portion of a shoulder at an intersection with the first recess. Additionally, a filler material may be disposed within the second recess to define at least a portion of an end surface of the cutting element pocket.

In additional embodiments, the present invention includes methods of forming an earth-boring tool such as, for example, any of those mentioned above. The methods include forming a bit body and using a rotating cutter to machine at least a portion of a cutting element pocket in the bit body in a manner that avoids mechanical tool interference problems and allows the pocket to be formed so as to sufficiently support a cutting element therein.

In yet additional embodiments, the present invention includes earth-boring tools having a bit body comprising a first recess defining a lateral sidewall surface of a cutting element pocket, a second recess located rotationally behind the first recess along a longitudinal axis of the cutting element pocket, and a shoulder region at an intersection between the first and second recesses providing a position for an inner end surface of the cutting element pocket. Additionally, a filler material may be disposed within the second recess and abutting the shoulder region, the filler material defining at least a portion of an inner end surface of the cutting element pocket.

BRIEF DESCRIPTION OF THE DRAWINGS

While the specification concludes with claims particularly pointing out and distinctly claiming that which is regarded as the present invention, the advantages of this invention may be more readily ascertained from the following description of the invention when read in conjunction with the accompanying drawings in which:

DETAILED DESCRIPTION

The illustrations presented herein are, in some instances, not actual views of any particular cutting element insert, cutting element, or drill bit, but are merely idealized representations which are employed to describe the present invention. Additionally, elements common between figures may retain the same numerical designation.

In some embodiments, the present invention includes methods of forming cutting element pockets that avoid or overcome at least some of the interference problems associated with previously known methods of forming such pockets, as well as drilling tools including the resulting cutting element pockets that are formed using such methods.

In the following description, certain terminology is used to describe certain features of one or more embodiments of the invention. As used herein, the term "cutting diameter" means the largest diameter of a machine tool cutter, such as a drill bit, a router, or a mill, taken perpendicular to a longitudinal axis of the cutter about which the cutter is rotated while the cutter is used to cut a workpiece. As used herein, the term "rotationally leading surface," when used with respect to a blade of an earth-boring tool, means a surface on a blade that leads the blade through rotation in a cutting direction of a body of a bit or other subterranean drilling tool about an axis. As used herein, the term "rotationally trailing surface," when used with respect to a blade of an earth-boring tool, means a surface on a blade that trails the blade through rotation as the blade rotates about the bit or other tool body axis in a cutting direction.

Figure 3:
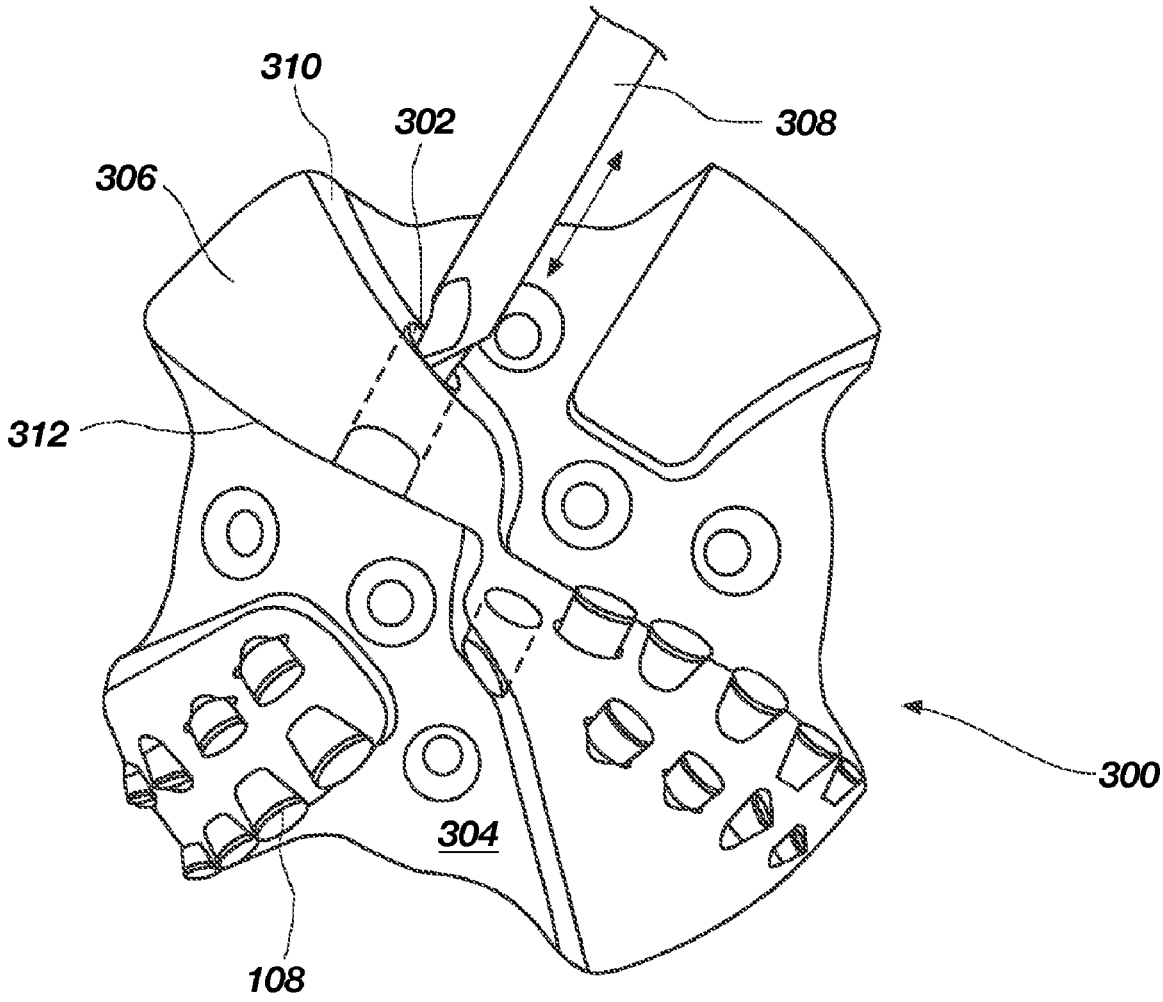
FIG. 3 is a plan view of the face on an earth-boring rotary drill bit illustrating a recess being formed in the body thereof according to an embodiment of the invention.

FIG. 3 is a plan view of the face of an earth-boring rotary drill bit 300 illustrating a recess 302 being formed in a bit body 304 according to one embodiment. Cutting elements 108 would not normally be present at this stage of manufacture of bit body 304, but are depicted in FIG. 3 on several of the blades 306 for reference and perspective. The recess 302 may be formed in a blade 306 on bit body 304 using a machining process. By way of example, and not limitation, recess 302 may be formed using a rotating cutter 308 of a multi-axis milling or drilling machine (not shown). In one embodiment, recess 302 may be formed by plunging rotating cutter 308 into bit body 304 from an entry point at or near the rotationally trailing surface 310 of blade 306. In some embodiments, rotating cutter 308 may continue through blade 306 until it exits at or near the rotationally leading surface 312 of blade 306. Because rotating cutter 308 may enter the bit body 304 at the rotationally trailing surface 310 of blade 306, the previously described mechanical interference problems associated with machining a recess 302 in a bit body 304 may be reduced or eliminated and a cutting element pocket may be created that enables the positioning of cutting elements with a low back rake angle.

The recess 302 may have a shape that is complementary to, or that corresponds with, an exterior shape of a cutting element to be secured at least partially within the recess 302, as described in further detail below. In some embodiments, the cutting element to be secured in a cutting element pocket may have a generally cylindrical body comprising a generally cylindrical lateral sidewall surface extending between two substantially planar end surfaces. Such configurations are commonly used for polycrystalline diamond compact (PDC) cutters. As a result, the recess 302 may have a generally cylindrical shape that is complementary to that of the cutting element to be secured therein. In some embodiments, the rotating cutter 308 may have a cutting diameter that is substantially the same as the diameter of the desired recess 302. In other embodiments, the cutting diameter of rotating cutter 308 may have a cutting diameter substantially smaller than the desired diameter of recess 302 as will be discussed in more detail below.

Figure 4:
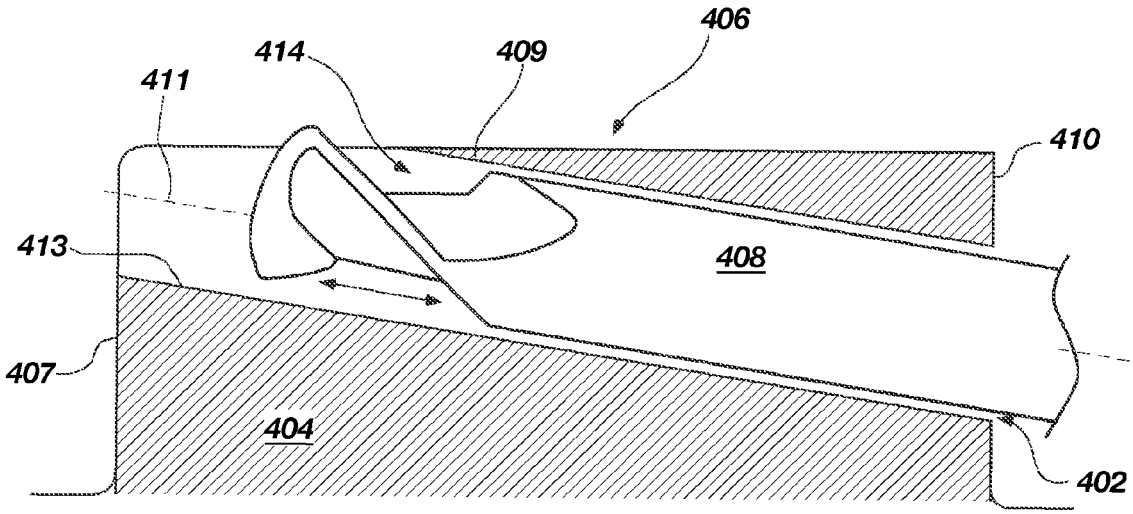
FIG. 4 is a partial cross-sectional view of a bit body illustrating the formation of a first recess in a rotationally trailing surface of a blade using a rotating cutter having a cutting diameter selected to define a diameter of the first recess being formed thereby according to an embodiment of the invention.

FIG. 4 is a partial cross-sectional view of a bit body 404 and illustrates the formation of a cutting element pocket 414 by forming first recess 402 that extends through the blade 406 from a location on or near a rotationally trailing surface 410 of the blade 406 to portions of one or both of the rotationally leading surface 407 and the outer surface 409 of blade 406. Rotating cutter 408 may enter blade 406 from the location at or near the rotationally trailing surface 410. The rotating cutter 408 may be oriented along a longitudinal axis 411 of cutting element pocket 414 as the first recess 402 is formed in blade 406. Rotating cutter 408 may form first recess 402 by machining in the directions of the arrows as rotating cutter 408 is rotated. First recess 402 may define at least a portion of a lateral sidewall surface 413 of cutting element pocket 414.

As can be appreciated from FIG. 4, first recess 402 is substantially the same diameter throughout and, thus, there may be no definition as to where a cutting element pocket may end. In other words, there may be no back surface of the cutting element pocket 414 against which a cutting element placed therein may rest and be supported during drilling of a subterranean formation. Such a back surface of the cutting element pocket 414 may be formed as described in further detail below.

Figure 5:
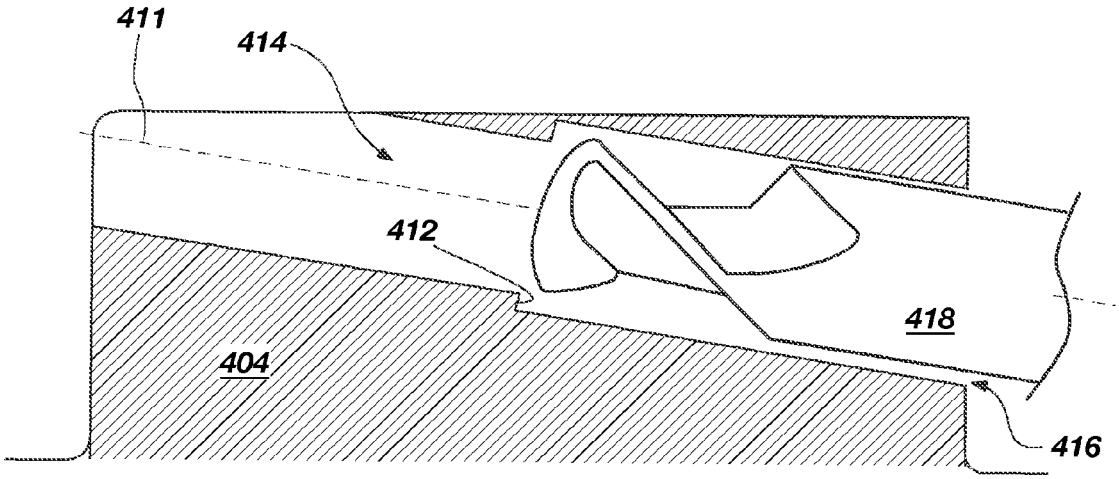
FIG. 5 is a partial cross-sectional view like that of FIG. 4 illustrating the formation of a second recess in the rotationally trailing surface of the blade using a cutter having a larger cutting diameter to define the diameter of the second recess and form an annular shoulder at an endpoint of the second recess that intersects the first recess to define a location of a back surface of a cutting element pocket according to an embodiment of the invention.

FIG. 5 illustrates a second recess 416 being formed in the blade 406 using a rotating cutter 418. In some embodiments, the second recess 416 may extend partially through the blade 406 toward the rotationally leading surface 407 thereof from a location on or near the rotationally trailing surface 410 of the blade 406. At least a portion of the second recess 416 may be positioned below and be at least partially covered by the outer surface 409 of blade 406. Rotating cutter 418 may enter blade 406 from the location at or near the rotationally trailing surface 410, and also may be oriented along, and concentric with, the longitudinal axis 411 of cutting element pocket 414 in the manner previously described with respect to formation of the first recess 402. In some embodiments, the second recess 416 may have a shape (e.g., round) generally similar to that of the first recess 402. The second recess 416 may be larger than the first recess 402 in at least one cross-sectional dimension such that a shoulder 412 is formed at the transition or intersection between the first recess 402 and the second recess 416. The shoulder 412 may define, or may be used to define, a location of a back surface of the cutting element pocket 414 being formed, as described in further detail below. As illustrated in FIG. 5, shoulder 412 comprises a substantially annular shoulder.

By way of example and not limitation, second recess 416 may be formed by machining a counterbore using a rotating cutter 418 having a cutting diameter larger than the cutting diameter of rotating cutter 408 (FIG. 4), as shown in FIG. 5. Rotating cutter 418 may be oriented along the longitudinal axis 411 of cutting element pocket 414 and plunged into the blade 406 to a desired depth from the rotationally trailing surface 410. The depth of second recess 416 may be determined by designers according to the specific needs of the earth-boring drill bit and the specific length of the cutting elements to be disposed in cutting element pocket 414.

Figure 6:
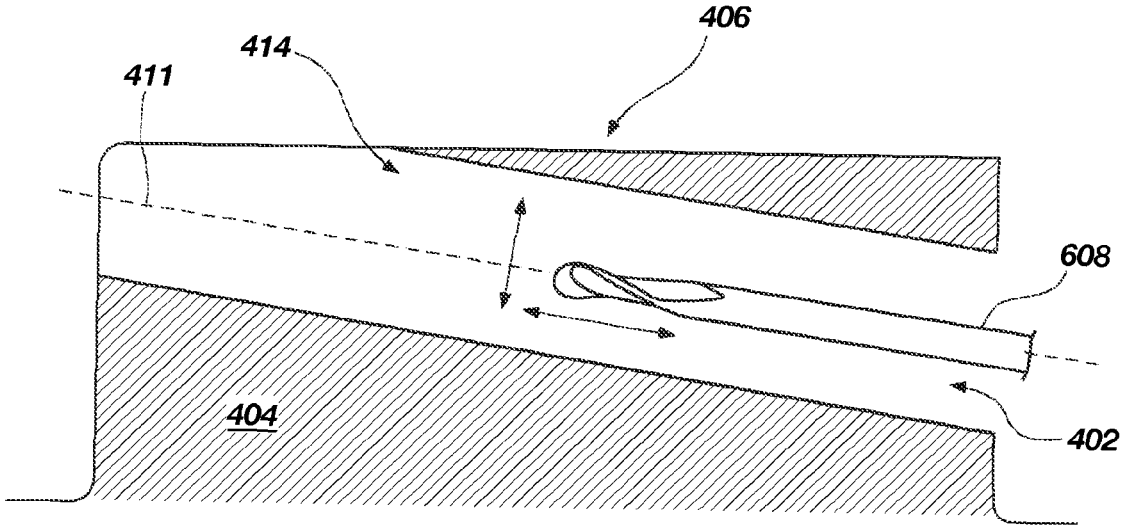
FIG. 6 illustrates a partial cross-sectional view of a bit body in which a first recess is formed with a rotating cutter having a cutting diameter that is substantially smaller than a diameter of a first recess according to an embodiment of the invention.
Figure 7A:
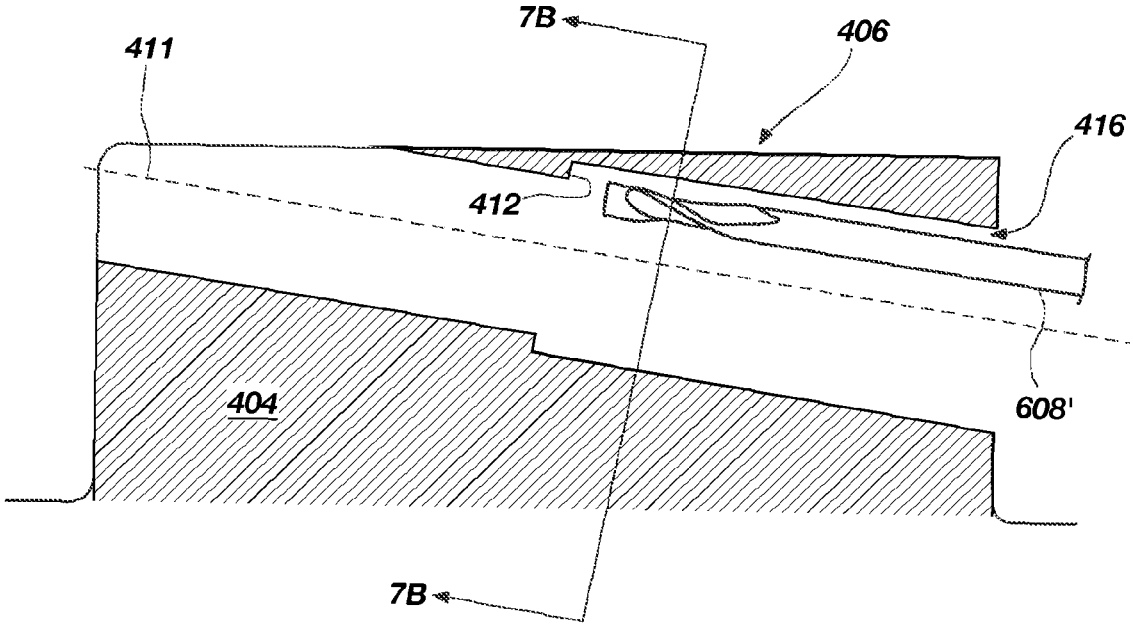
FIG. 7A is a partial cross-sectional view like that of FIG. 6 illustrating the formation of a second recess in the rotationally trailing surface of the blade using a cutter having a cutting diameter that is substantially smaller than the diameter of the second recess to form an annular shoulder that intersects the first recess and defines a location of a back surface of a cutting element pocket according to an embodiment of the invention.

In additional embodiments, the rotating cutter used to create the first and/or second recess 402, 416 may be substantially smaller than the recess to be formed. For example, FIG. 6 illustrates a partial cross-sectional view of a bit body 404 having a first recess 402 formed in blade 406 with a rotating cutter 608. Rotating cutter 608 may have a cutting diameter that is substantially smaller than the desired diameter of first recess 402 formed in blade 406. In this embodiment, rotating cutter 608 may be moved in the directions of the arrows shown in FIGS. 6 and 7B to form first recess 402 oriented along longitudinal axis 411 of cutting element pocket 414. FIG. 7A illustrates another rotating cutter 608' of relatively small diameter and having a flat, distal end face being used to enlarge first recess 402 to form second recess 416 and shoulder 412 by machining the blade 406 generally parallel to, but laterally offset from, longitudinal axis 411 of cutting element pocket 414.

Figure 7B:
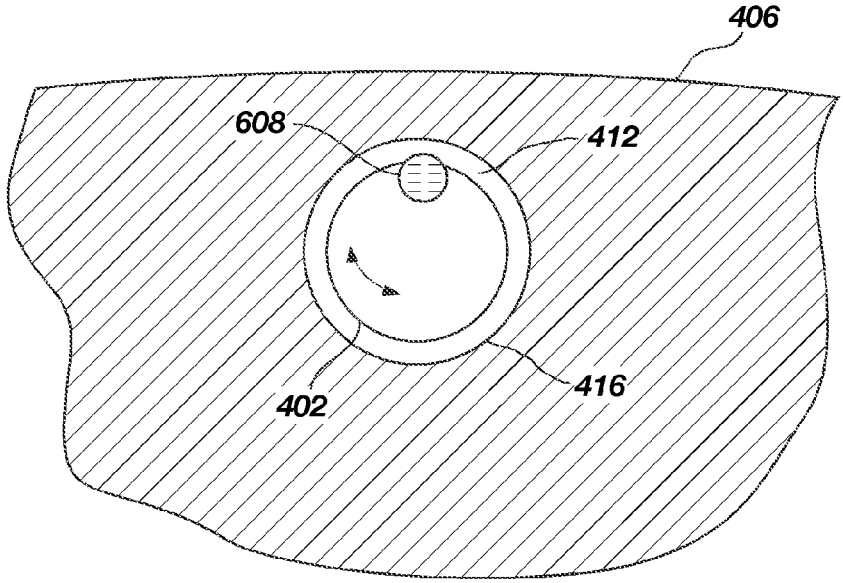
FIG. 7B is a cross-sectional view of the bit body shown in FIG. 7A taken along section line 7B-7B shown therein and illustrates a rotating cutter inside the second recess.

FIG. 7B is a cross-sectional view of the bit body 404 shown in FIG. 7A taken along section line 7B-7B shown therein. FIG. 7B illustrates a rotating cutter 608 inside second recess 416. Although first and second recesses 402, 416 are shown as having a circular cross-section, it will be appreciated by one of ordinary skill that first and second recesses 402, 416 may be formed with any cross-section suitable for different shapes and configurations of cutting elements. By way of example, and not limitation, first recess 402 and/or second recess 416 may have an ovoid shape, a rectangular shape, a tombstone shape, etc.

Figure 8A:
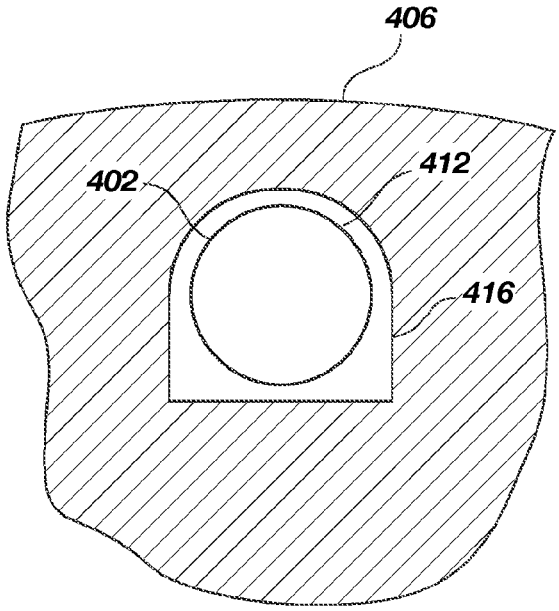
FIG. 8A is a cross-sectional view like that of FIG. 7B illustrating another embodiment of a bit body that also includes a first recess, a second recess, and a shoulder at an intersection of the first and second recesses that defines a location of a back surface of a cutting element pocket in the bit body.
Figure 8B:
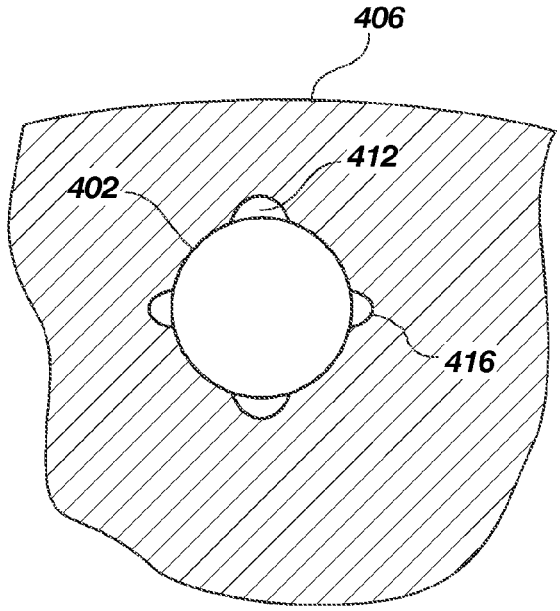
FIG. 8B is a cross-sectional view like that of FIG. 7B illustrating yet another embodiment of a bit body that includes a first recess, a second recess, and a plurality of circumferentially disposed shoulders at an intersection of the first and second recesses that define a location of a back surface of a cutting element pocket in the bit body.

Shoulder 412 is also shown as resulting from a step down in size from the second recess 416 to the first recess 402, wherein, in some embodiments, second recess 416 has the same or similar geometry as first recess 402. For example, first recess 402 and second recess 416 each may be generally cylindrical, with second recess 416 exhibiting a greater lateral extent (diameter) than first recess 402. The first recess 402 and second recess 416 may each be longitudinally aligned with the axis 411. Thus, shoulder 412 may be formed at a point at the intersection or transition between the first recess 402 and second recess 416. The shoulder 412 may comprise a surface of the blade 406, and may have a generally annular shape in some embodiments. However, it will be apparent to one of ordinary skill in the art that first recess 402 and the second recess 416 each may have a variety of different geometries and may differ from the geometry of first recess 402 and the second recess 416 as shown in the figures. As a non-limiting example, first recess 402 may comprise a substantially circular cross-sectional shape, and second recess 416 may comprise a tombstone cross-sectional shape, as shown in FIG. 8A. FIG. 8B shows another non-limiting example of an embodiment in which the cross-sectional shape of the second recess 416 includes a central portion that is substantially identical to the cross-sectional shape and size of first recess 402 and one or more second regions comprising slots, keyways, or other openings that each extend in a generally radially outward direction beyond the cross-sectional area of the first recess 402 to create one or more shoulders 412 at the intersection or transition between the first recess 402 and the second recess 416.

Although the embodiments illustrated in FIGS. 4 through 7A show first recess 402 formed before second recess 416 when forming cutting element pocket 414, a person of ordinary skill in the art will recognize the second recess 416 may be formed prior to forming first recess 402. In these embodiments, a rotating cutter, such as rotating cutter 418 (FIG. 5) or rotating cutter 608' (FIG. 7A), may be used to form second recess 416 by machining from the rotationally trailing surface 410 of blade 406 along longitudinal axis 411 of cutting element pocket 414 until the desired depth and diameter are reached. A rotating cutter, such as rotating cutter 408 (FIG. 4) or rotating cutter 608 (FIG. 6), may then be used to form first recess 402 by entering second recess 416 from the rotationally trailing surface 410 of blade 406 and machining first recess 402 along longitudinal axis 411 of cutting element pocket 414 to the rotationally leading surface 407 and outer surface 409 of blade 406.

The present invention has utility in relation to earth-boring rotary drill bits and other tools having bodies substantially comprised of a metal or metal alloy such as steel, but also has utility in relation to earth-boring rotary drill bits and other tools. For example, the present invention has utility in bit and tool fabrication methods wherein bodies comprising particle-matrix composite materials are manufactured in an effort to improve the performance and durability of earth-boring rotary drill bits. Such methods are disclosed in pending U.S. patent application Ser. No. 11/271,153, filed Nov. 10, 2005 and pending U.S. patent application Ser. No. 11/272,439, also filed Nov. 10, 2005, the disclosure of each of which application is incorporated herein in its entirety by this reference.

Figure 1:
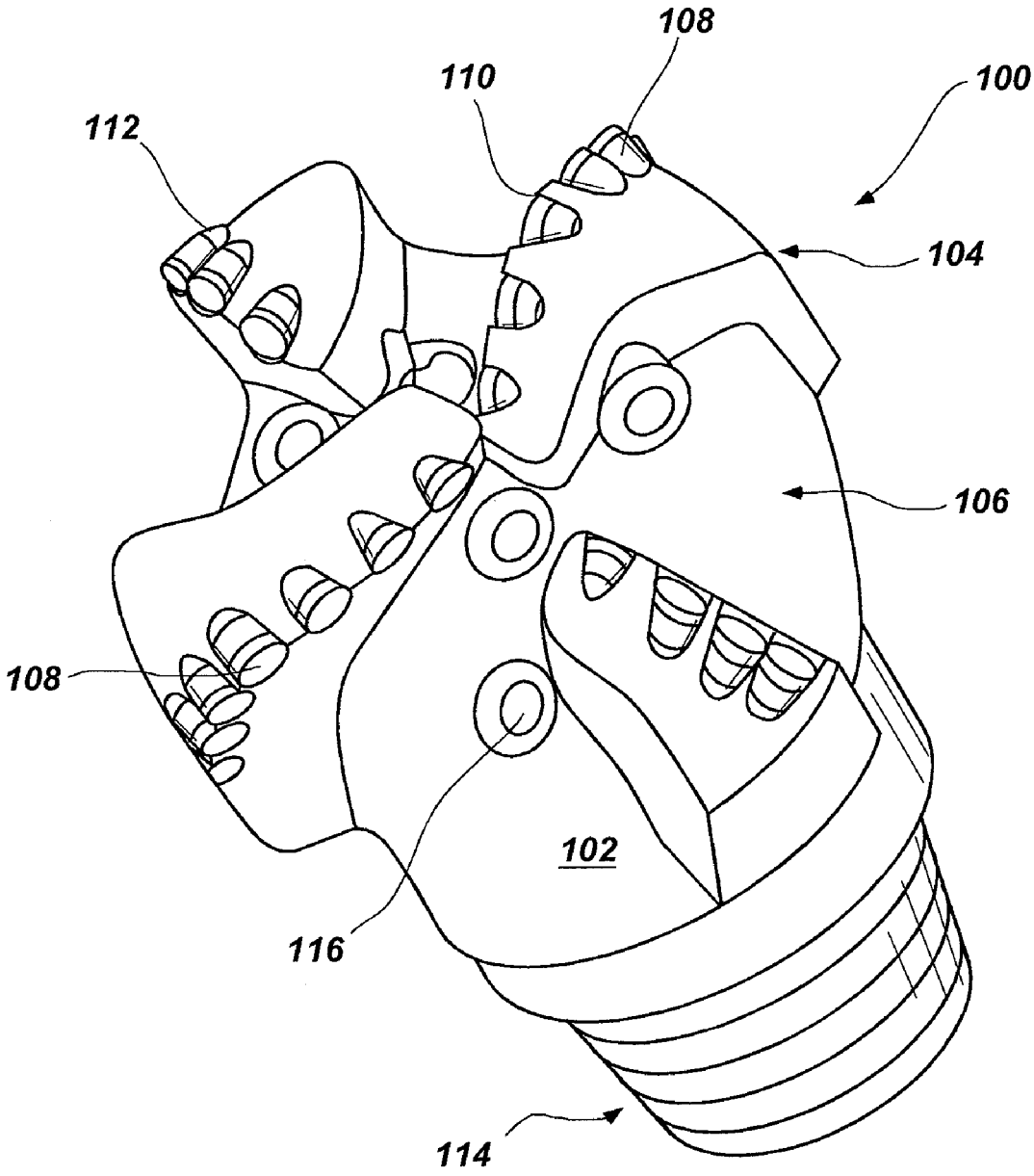
FIG. 1 Prior Art
FIG. 1 illustrates a conventional fixed-cutter earth-boring rotary drill bit.
Figure 2:
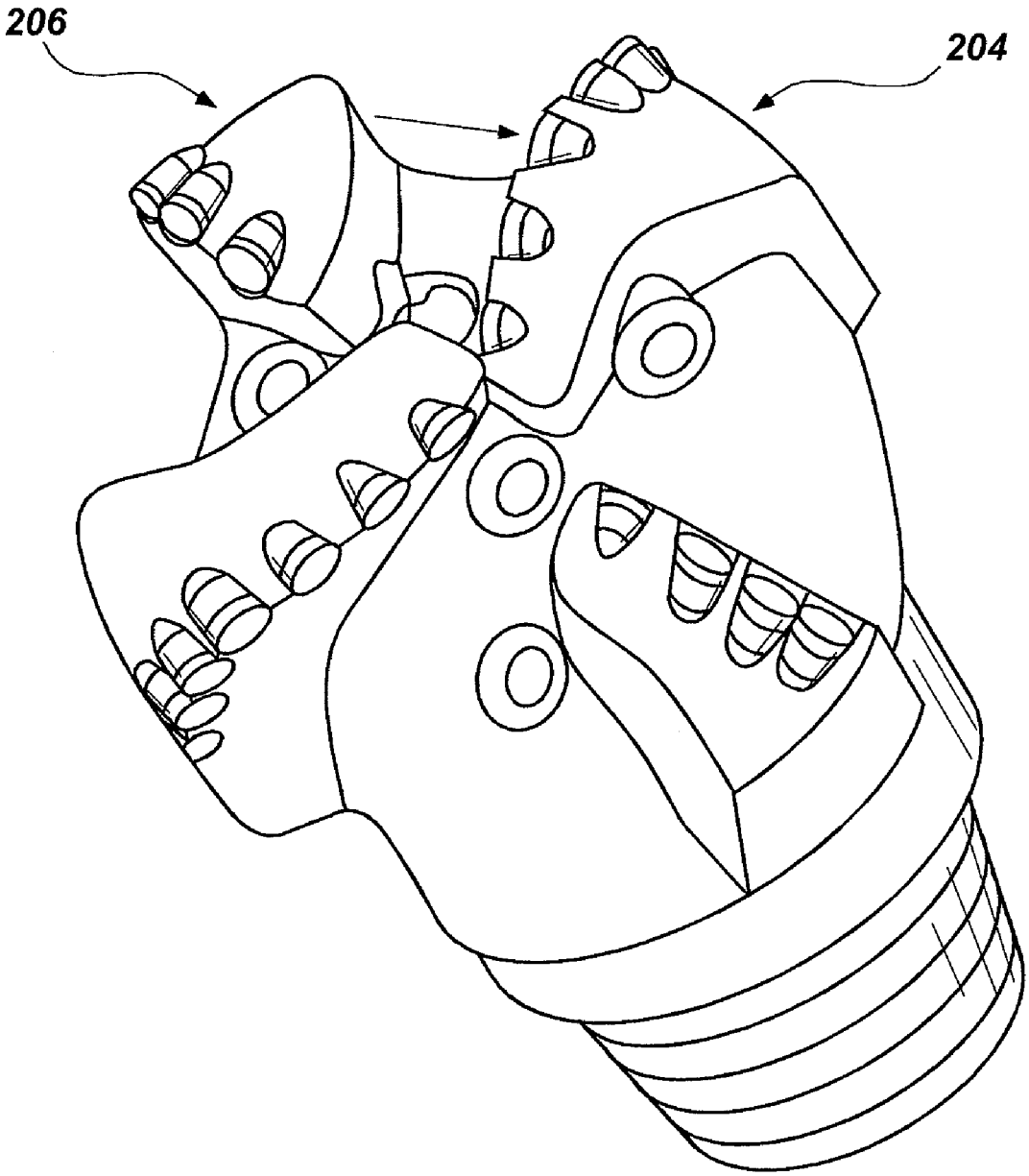
FIG. 2 Prior Art
FIG. 2 illustrates blade interference that may occur while machining a cutting element pocket into a leading surface of an earth-boring rotary drill bit like that shown in FIG. 1.

In contrast to conventional infiltration methods (in which hard particles (e.g., tungsten carbide) are infiltrated by a molten liquid metal matrix material (e.g., a copper based alloy) within a refractory mold), these new methods generally involve pressing a powder mixture to form a green powder compact, and sintering the green powder compact to form a bit body. The green powder compact may be machined as necessary or desired prior to sintering using conventional machining techniques like those used to form steel bit bodies. Furthermore, additional machining processes may be performed after sintering the green powder compact to a partially sintered brown state, or after sintering the green powder compact to a desired final density. For example, it may be desired to machine cutting element pockets on one or more blades 104 (FIG. 1) of a bit body formed by such a process while the bit body is in the green, brown, or fully sintered state. However, as with steel-bodied drill bits, interference problems may prevent the formation of the desired cutting element pockets. To overcome such interference problems, methods of the present invention, such as those previously described herein, may be used to for one or more cutting element pockets in one or more blades (such as the blades 104 shown in FIG. 1) of a bit body formed by such a process while the bit body is in the green, brown, or fully sintered state. Therefore, the present invention also has utility in relation to earth-boring tools having bit bodies substantially comprised of a particle-matrix composite material.

Figure 9:
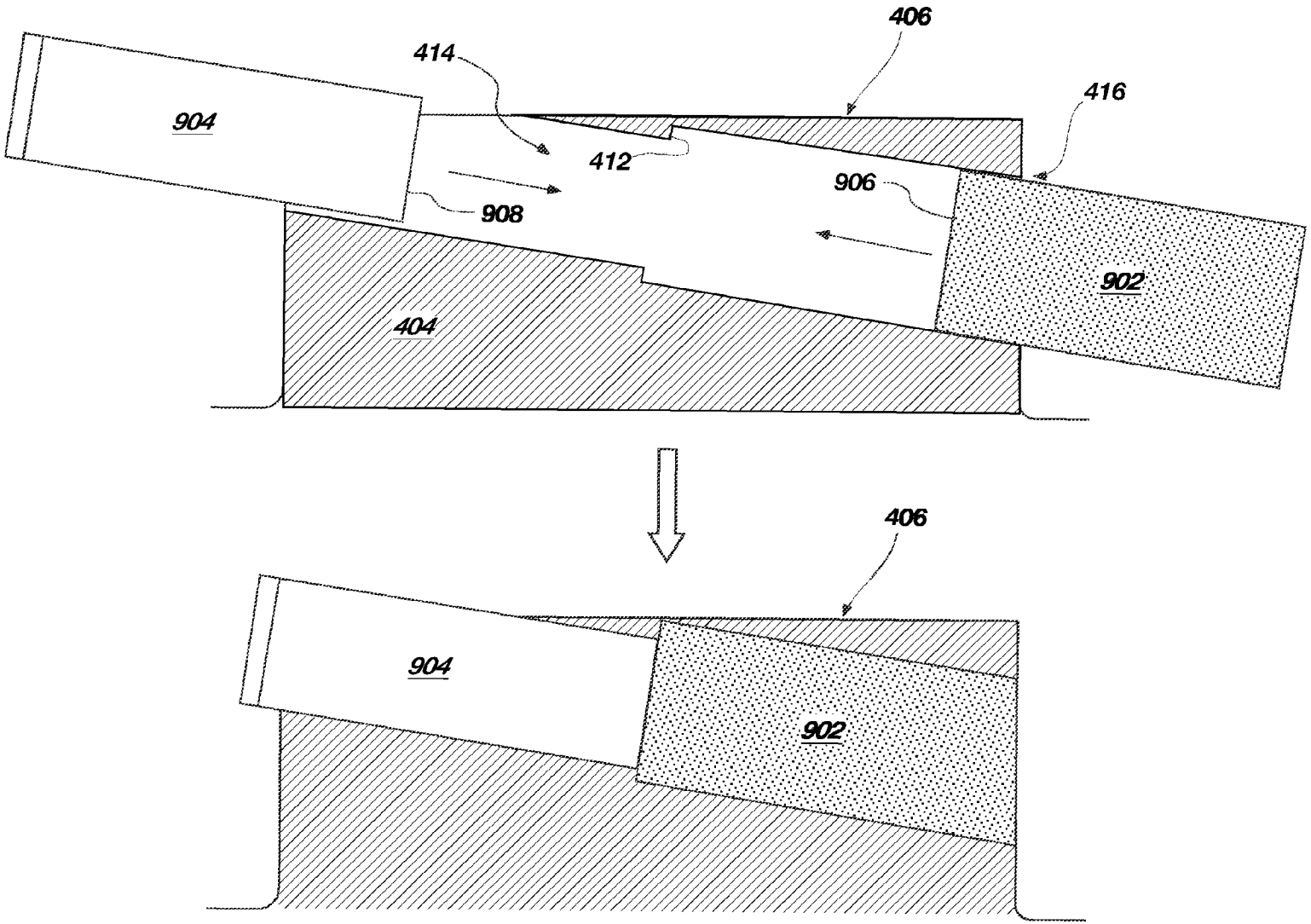
FIG. 9 is a side, partial cross-sectional view illustrating placement of a plug or filler material in a second recess like that shown in FIG. 5, and placement of a cutting element into a first recess like that shown in FIG. 5 according to an embodiment of the invention.

In some embodiments, after forming one or more cutting element pockets in a bit body of an earth-boring rotary drill bit as previously described, a plug or other mass of filler material may be disposed in the second recess 416. Additionally, a cutting element may be positioned within each cutting element pocket 414 and secured to the blade 406. FIG. 9 is a side, partial cross-sectional view illustrating a cutting element pocket 414 as defined by first and second recesses 402, 416. A plug or other mass of filler material 902 may be disposed in second recess 416 and may be placed so that at least a portion of a leading face 906 of the plug or filler material 902 may abut against shoulder 412. At least a portion of the leading face 906 may be configured to define the back surface (e.g., rear wall) of the cutting element pocket 414 against which a cutting element 904 may abut and rest. Filler material 902 may be used to replace the excess material removed from the bit body 404 when forming the first recess 402 and the second recess 416, and to fill any portion or portions of the first recess 402 and the second recess 416 that are not comprised by the cutting element pocket 414. By way of example and not limitation, filler material 902 may comprise a preformed solid structure that is constructed and formed to have a shape corresponding to that of at least a portion of second recess 416.

Filler material 902 shown in FIG. 9 may comprise a preformed solid plug structure that may be positioned behind cutting element 904 within second recess 416 and secured within blade 406. In some embodiments the preformed solid plug structure may comprise a solid metal or alloy plug, such as a steel plug in the case of a steel body earth-boring drilling tool.

In some embodiments, the preformed solid plug structure may comprise a green powder compact structure or a partially sintered brown structure as described above. In such embodiments, the preformed solid plug structure may be disposed within second recess 416, and the preformed solid structure and the blade 406 may be co-sintered to form a bond between the bit body 404 and the preformed solid structure. In some embodiments, the blade 406 also may comprise a green powder compact structure or a partially sintered brown structure prior to such a co-sintering process, while in other embodiments, the bit body 404 including blade 406 may be substantially fully sintered (i.e., sintered to a desired final density) prior to such a co-sintering process.

In some embodiments, the preformed solid plug structure may be separately fabricated, of a solid metal or alloy as noted above, positioned within second recess 416, and secured to one or more surrounding surfaces of bit body 404. The preformed solid plug structure may be secured to one or more surrounding surfaces of bit body 404 using, for example, an adhesive, a brazing process, a flamespray process, or a welding process. The preformed solid plug structure may be cooled, for example in liquid nitrogen, inserted in second recess 416, and allowed to expand during warming to create an interference fit with blade 406. In some embodiments, a preformed solid plug structure may be positioned within second recess 416 and secured to bit body 404 prior to securing a cutting element 904 in the cutting element pocket 414.

In still other embodiments, filler material 902 may comprise a foreshortened plug which does not completely fill second recess 416 when abutting shoulder 412, and a welding alloy, a solder alloy, or a brazing alloy may be applied using a corresponding welding, soldering, or brazing process to fill the remainder of second recess 416. In such embodiments, a hardfacing material (e.g., a particle-matrix composite material) may be applied using a welding process (e.g., arc welding processes, gas welding processes, resistance welding processes, etc.) or a flamespray process to provide enhanced abrasion and erosion resistance over the filler. By way of example and not limitation, any of the hardfacing materials described in pending U.S. patent application Ser. No. 11/513,677, filed Aug. 30, 2006, the disclosure of which is incorporated herein in its entirety by this reference, may be used as filler material 902, and may be applied to the blade 406 of bit body 404 as described therein. As an example, a particle-matrix composite material comprising particles of tungsten carbide dispersed throughout a metal alloy predominantly comprised of at least one of nickel and cobalt may be used as filler material 902.

In such embodiments, as the filler material employed to backfill second recess 416 behind plug 902 may comprise at least one of a welding alloy, a solder alloy, or a brazing alloy, and a hardfacing material may be applied over exposed surfaces thereof, such layered combinations of materials may be selected to form a composite or graded structure between the cutting element 904 and the surrounding bit body 404 that is selected to tailor at least one of the strength, toughness, wear performance, and erosion performance of the region in the immediate vicinity of cutting element 904 for the particular design of the drilling tool, location of cutting element 904 on the drilling tool, or the application in which the drilling tool is to be used.

Cutting element 904 may be secured within cutting element pocket 414 such that each cutting element 904 is positioned in a forward-facing orientation, taken in the intended direction of tool rotation during use. Each cutting element 904 may include a rear face 908 which may abut against at least a portion of the leading face 906 of the filler material 902, which defines a back surface of the cutting element pocket 414. Thus, filler material 902 may create a support from behind when cutting element 904 abuts against leading face 906. Cutting element 904 may further be secured within cutting element pocket 414. By way of example and not limitation, each cutting element 904 may be secured within a cutting element pocket 414 using a brazing alloy, a soldering alloy, or an adhesive material disposed between the sides thereof and the inner surface of cutting element pocket 414, as known in the art.

Figure 10:
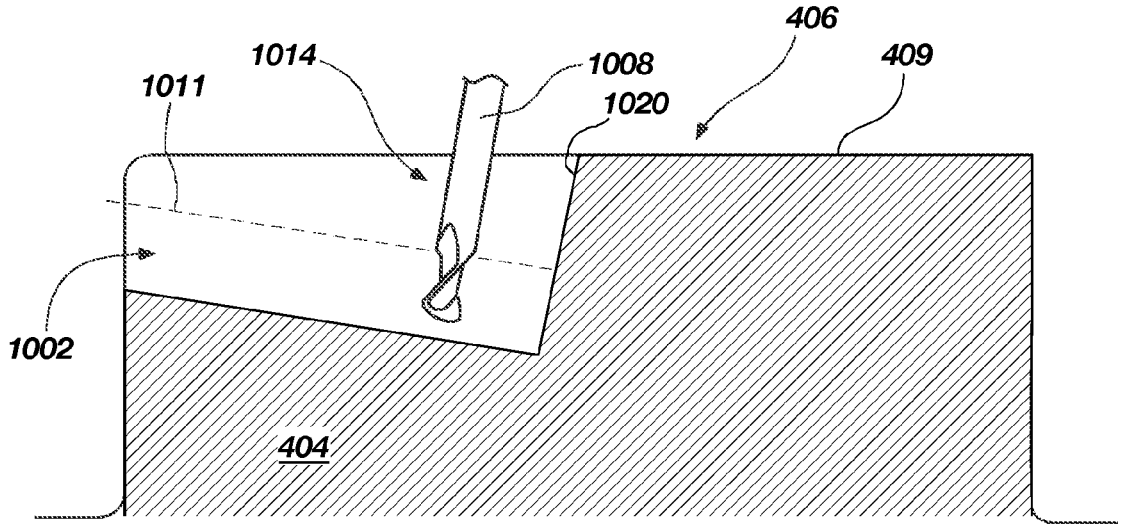
FIG. 10 is a partial cross-sectional view like that of FIG. 4 illustrating the formation of a first recess in a formation engaging surface of a blade using a rotating cutter according to an embodiment of the invention.
Figure 11A:
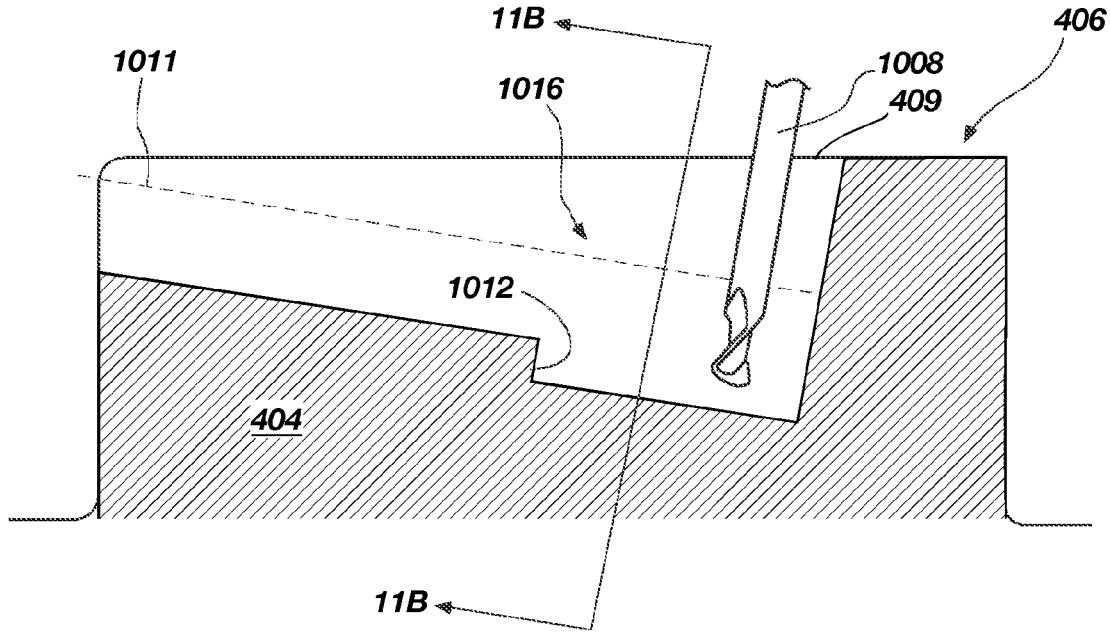
FIG. 11A is a partial cross-sectional view like that of FIG. 10 illustrating the formation of a second recess in the formation engaging surface of the blade and the formation of a shoulder that intersects the first recess and defines a location of a back surface of a cutting element pocket according to an embodiment of the invention.

Recently, new methods of forming cutting element pockets by forming a recess to define a lateral sidewall surface of a cutting element pocket using a rotating cutter oriented at an angle relative to the longitudinal axis of the cutting element pocket being formed. Such methods are disclosed in pending U.S. patent application Ser. No. 11/717,905, filed Mar. 13, 2007, the disclosure of which application is incorporated herein in its entirety by this reference. Referring to FIG. 10, a partial cross-sectional view of a blade 406 on a bit body 404 is shown and illustrates the formation of cutting element pocket 1014 by forming a first recess 1002. Cutting element pocket 1014 may be formed by machining first recess 1002 using rotating cutter 1008 oriented at an angle relative to the longitudinal axis 1011 of cutting element pocket 1014 and machining into blade 406 from the outer surface 409. FIG. 11A illustrates a second recess 1016 being formed in blade 406 using the same or another rotating cutter 1008 oriented at an angle relative to the longitudinal axis 1011 and plunging the rotating cutter 1008 into blade 406 from the outer surface 409. A shoulder 1012 at the intersection of first recess 1002 and second recess 1016 may also be formed to define the location of a back surface of the cutting element pocket 1014 being formed.

Figure 11B:
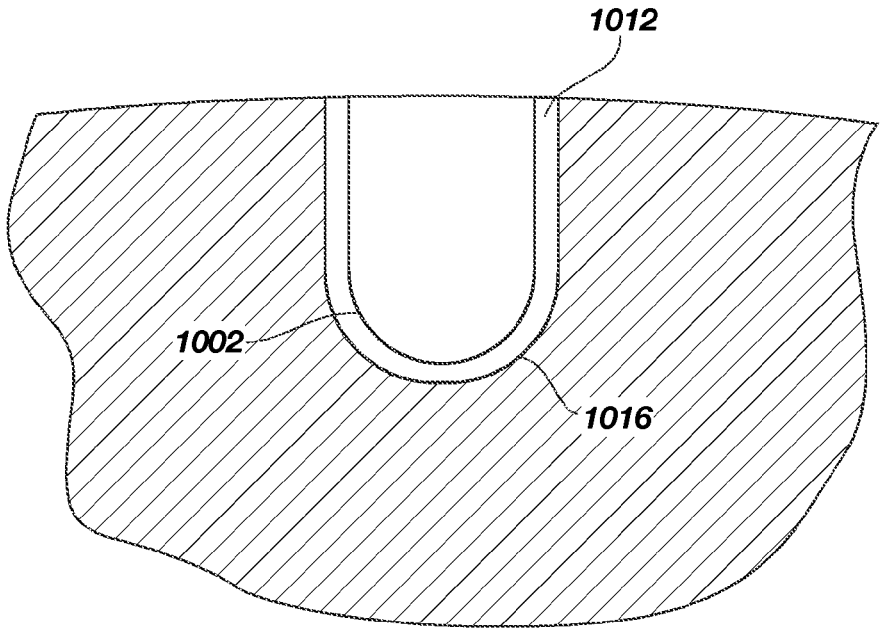
FIG. 11B is a partial cross-sectional view of the bit body shown in FIG. 11A taken along section line 11B-11B shown therein and illustrates the shoulder that intersects the first recess and the second recess according to an embodiment of the invention.
Figure 12:
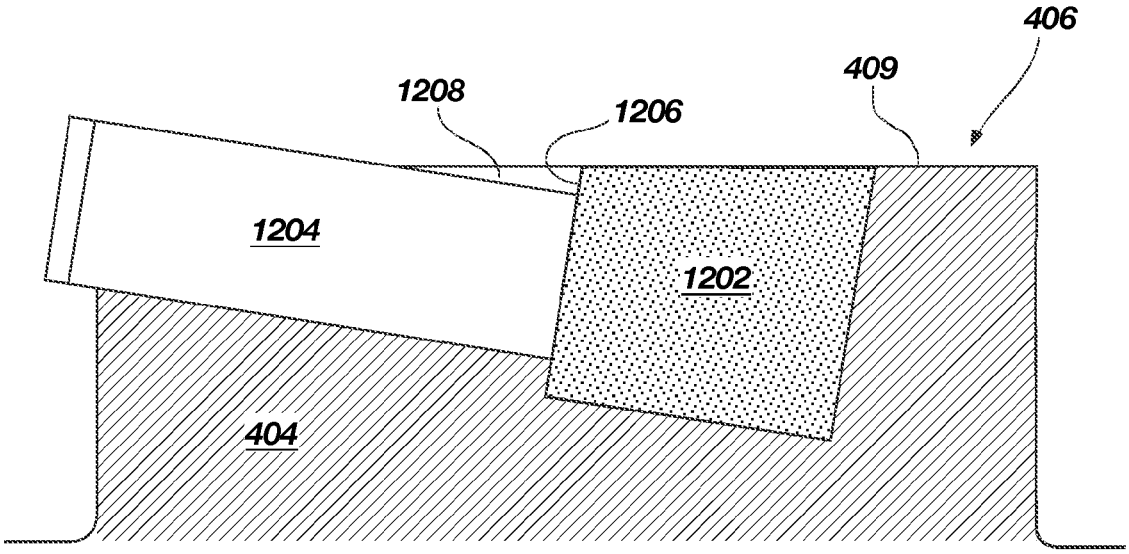
FIG. 12 is a side, partial cross-sectional view illustrating placement of a plug or filler material in a second recess as shown in FIG. 11A, and placement of a cutting element into a first recess as shown in FIG. 11A.

FIG. 11B is a cross-sectional view of the bit body 404 shown in FIG. 11A taken along section line 11B-11B shown therein. FIG. 11B illustrates shoulder 1012 formed at the intersection of first recess 1002 and second recess 1016. As illustrated in FIG. 12, a plug or other filler material 1202 may be positioned within the second recess 1016 so that at least a portion of a leading face 1206 of the plug or filler material 1202 may abut against shoulder 1012. In some embodiments, at least a portion of the leading face 1206 may be configured to define the back surface or rear wall of the cutting element pocket 1014 against which a cutting element 1204 may abut and rest. In other embodiments the plug or filler material 1202 may be configured as a pocket (similar to 1310 in FIG. 13B) into which a portion of cutting element 1204 may be received, the plug or filler material at least partially surrounding the portion of the cutting element 1204. Plug pr filler material 1202 may be formulated according to any of the material options for plug or filler material 902 (FIG. 9) as described above. Additionally, plug or filler material 1202 may be disposed and secured according to any of the methods described above with regards to plug or filler material 902. Cutting element 1204 may be secured within the cutting element pocket in a manner similar to that described above with regard to cutting element 904 (FIG. 9).

A void 1208 may be present in the outer surface 409 of blade 406 above cutting element 1204. Void 1208 may be filled with plug or filler material 1202 in some embodiments. In other embodiments, void 1208 may be filled with a plug or filler material that differs from plug or filler material 1202. For example, plug 1202 may comprise a preformed solid structure while void 1208 may be filled with a hardfacing material. Any combination of materials as described above with relation to plug or filler material 902 may be employed to fill void 1208.

Figure 13A:
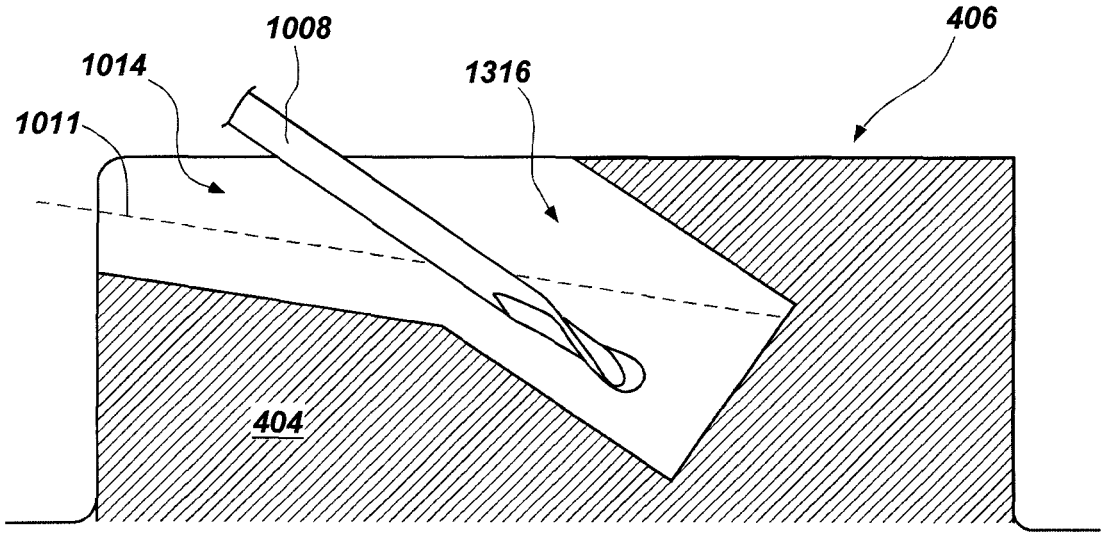
FIG. 13A is a cross-section view similar to that of FIG. 10 illustrating a second recess 1316 being formed therein using a rotating cutter oriented at an angle of less than ninety degrees (90°) relative to the longitudinal axis of the cutting element pocket.

In additional embodiments a cutting element pocket 1014 may be formed similar to cutting element pocket 1014 of FIG. 10, above. A second recess 1316 may be formed in blade 406 using the same or another rotating cutter 1008 oriented at an angle of less than ninety degrees (90°) relative to the longitudinal axis 1011 of cutting element pocket 1014, as shown in FIG. 13A. The second recess 1316 may be formed by machining in a rear surface 1020 (FIG. 10) of the cutting element pocket 1014 at the selected angle. As a non-limiting example, the rotating cutter 1008 may be oriented at an acute angle of between about ninety degrees (90°) and about thirty degrees (30°) relative to the longitudinal axis 1011 of the cutting element pocket 1014 when forming the second recess 1316. This angle of cut may provide a second recess 1316 that is formed below the outer surface 409 of blade 406. In other words, the second recess 1316 may be entirely or partially covered by the outer surface 409 of blade 406.

Figure 13B:
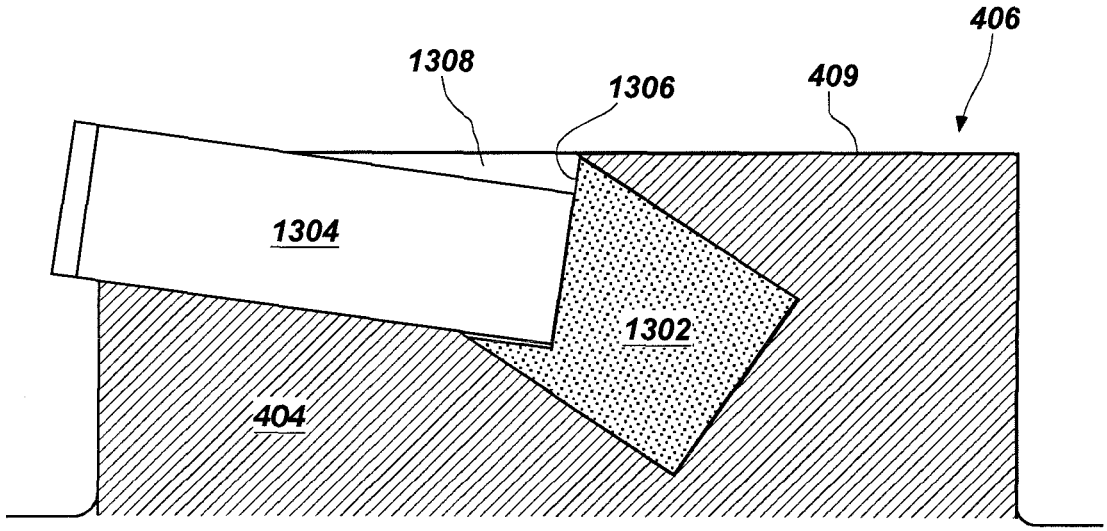
FIG. 13B is a side, partial cross-sectional view illustrating placement of a plug or filler material in a second recess as shown in FIG. 13A, and placement of a cutting element into a first recess as shown in FIG. 13A.

As illustrated in FIG. 13B, a plug or filler material 1302 may be positioned within the second recess 1316. Plug or filler material 1302 may comprise face 1306 configured to define the back surface or rear wall against which a cutting element 1304 may abut and rest. Plug or filler material 1302 may be disposed and secured according to any of the methods described above with regards to plug or filler material 902 (FIG. 9). Cutting element 1304 may be secured within the cutting element pocket in a manner similar to that described above with regard to cutting element 904 (FIG. 9).

A void 1308, similar to void 1208 (FIG. 12), may be present in the outer surface 409 of blade 406 above cutting element 1304. In some embodiments, void 1308 may be filled with a plug or filler material that differs from plug or filler material 1302. For example, plug 1302 may comprise a preformed solid structure while void 1308 may be filled with a hardfacing material. Any suitable combination of materials as described above with relation to plug or filler material 902 may be employed to fill void 1308.

Figure 13C:
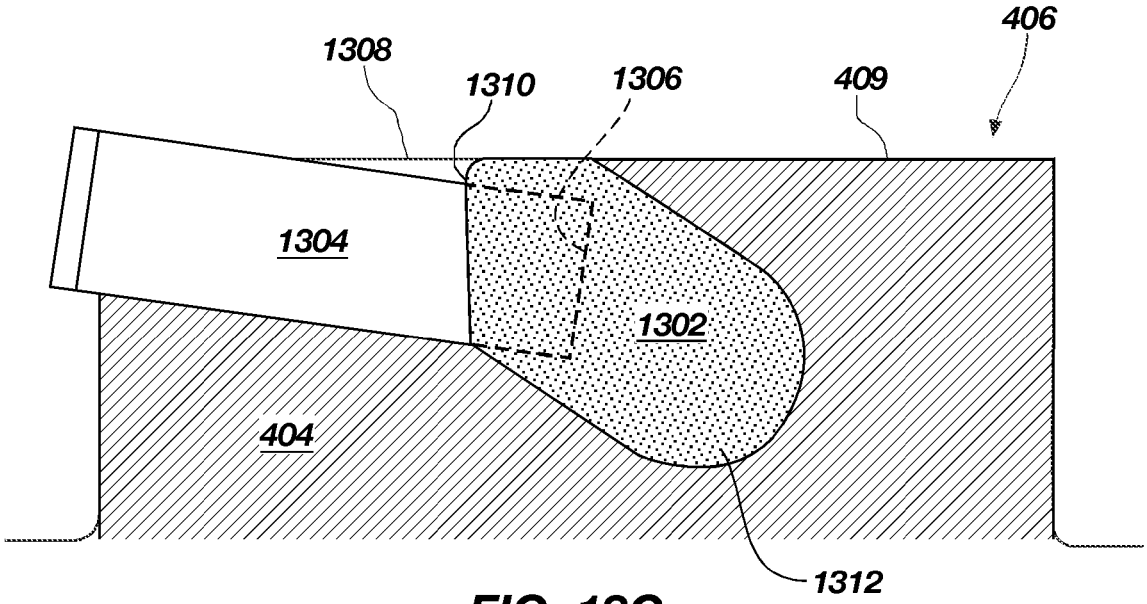
FIG. 13C is a partial cross-section view like that of 13B illustrating a plug or filler material including a pocket for receiving a portion of a cutting element.

In some embodiments of the present invention, plug or filler material 1302 may include a pocket 1310 formed therein and configured to receive a portion of cutting element 1304, as illustrated in FIG. 13C. In such embodiments, pocket 1310 may be configured to fully surround a rear portion of cutting element 1304 abutting against face 1306. By way of a non-limiting example only, the broken lines shown in FIG. 13C illustrate pocket 1310 having a cutting element 1304 positioned therein, the plug or filler material 1302 fully surrounding a portion of cutting element 1304. In other embodiments (not shown), the plug or filler material 1302 may be configured such that pocket 1310 may only partially surround cutting element 1304 at an area proximate the rear portion, as illustrated in FIG. 13C. Additionally, plug or filler material 1302 may be configured to completely fill or only partially fill void 1308. Furthermore, some embodiments of plug or filler material 1302 may include a rear portion 1312 that is configured with a particular, selected shape. By way of non-limiting example only, FIG. 13C illustrates an embodiment having a dome-shaped rear portion 1312, the second recess 1316 being formed to have a complementary configuration to receive the plug or filler material 1302.

Figure 14:
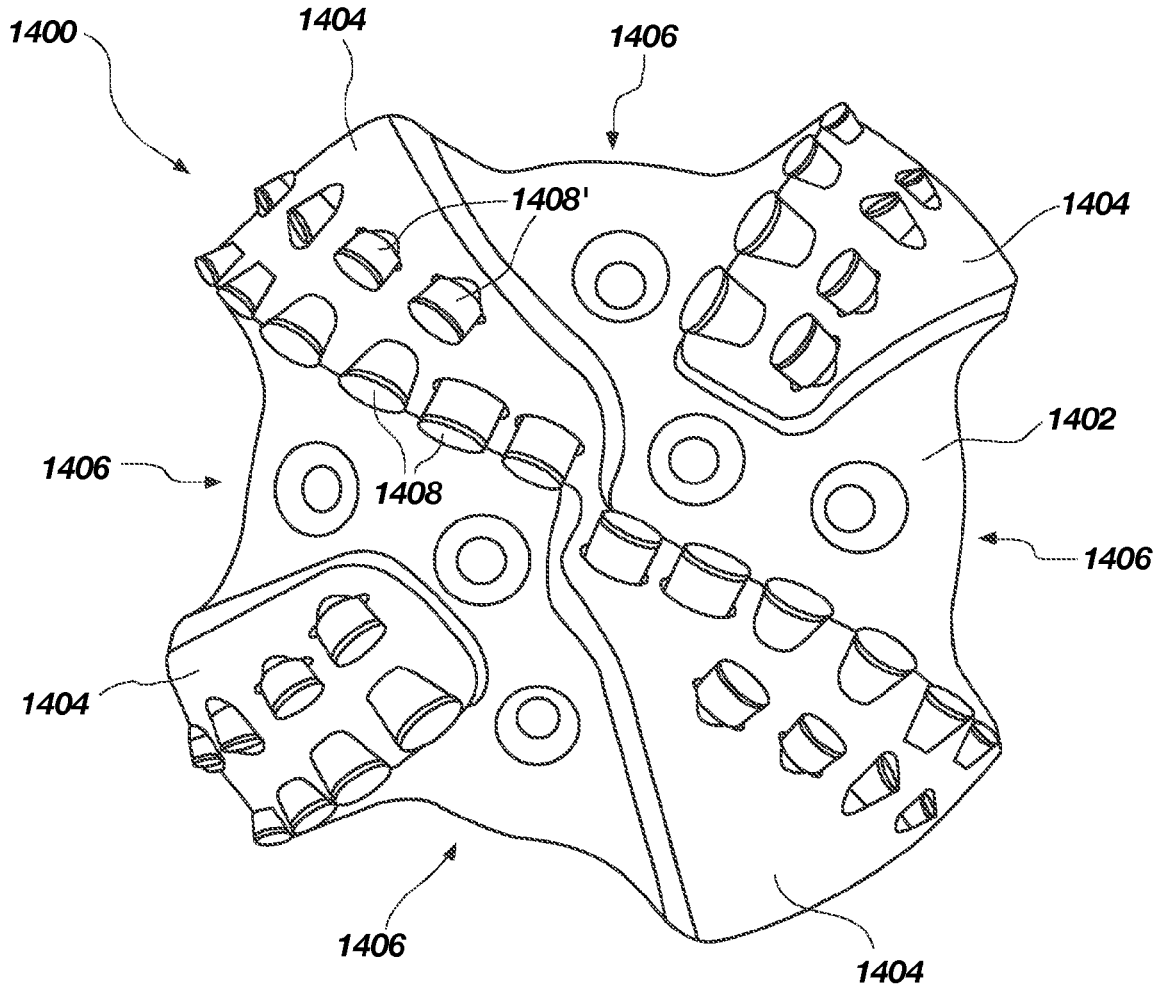
FIG. 14 is a plan view of the face of an embodiment of an earth-boring rotary drill bit of the present invention.

FIG. 14 is a plan view of the face of an embodiment of an earth-boring rotary drill bit 1400 according to the present invention. The earth-boring rotary drill bit 1400 includes a bit body 1402 having a plurality of generally radially projecting and longitudinally extending wings or blades 1404, which are separated by junk slots 1406 extending from channels on the face of the bit body 1402. A plurality of primary PDC cutting elements 1408 are provided on each of the blades 1404 within cutting element pockets 414 (FIG. 9). A plurality of secondary PDC cutting elements 1408' are also provided within cutting element pockets 414 on each of the blades 1404 rotationally behind the primary cutting elements 1408.

By using embodiments of cutting element pockets of the present invention, cutters may be secured to the face of a bit body at relatively low back rake angles without encountering mechanical tool interference problems. As a result, earth-boring drilling tools, such as the earth-boring rotary drill bit 1400 shown in FIG. 14 may be provided that are capable of drilling at increased rates of penetration relative to previously known drilling tools having machined cutter pockets, and similar to rates of penetration achieved using drilling tools having cutter pockets formed in a casting process (e.g., infiltration) used to fabricate so-called "matrix-type" bits. For example, the cutting element pockets 414 (FIG. 9) on the so-called "cone region" of one or more of the blades 1404 may be formed using methods described herein, and may be configured such that the PDC cutting elements 1408 disposed therein are oriented at backrake angles of less than about twenty degrees (20°). For example, the PDC cutting elements 1408 in the cone region of one or more blades 1404 of the drill bit 1400 may be disposed at a back rake angle of between about ten degrees (10°) and about seventeen degrees (17°).

While the present invention has been described herein in relation to embodiments of earth-boring rotary drill bits that include fixed cutters, other types of earth-boring tools such as, for example, core bits, eccentric bits, bicenter bits, reamers, mills, roller cone bits, and other such structures known in the art may embody teachings of the present invention and may be formed by methods that embody teachings of the present invention, and, as used herein, the term "body" encompasses bodies of earth-boring rotary drill bits, as well as bodies of other earth-boring tools including, but not limited to, core bits, eccentric bits, bicenter bits, reamers, mills, roller cone bits, as well as other drilling and downhole tools.

Furthermore, while the present invention has been described herein with respect to certain preferred embodiments, those of ordinary skill in the art will recognize and appreciate that it is not so limited. Rather, many additions, deletions and modifications to the preferred embodiments may be made without departing from the scope of the invention as hereinafter claimed. In addition, features from one embodiment may be combined with features of another embodiment while still being encompassed within the scope of the invention as contemplated by the inventors. Further, the invention has utility with different and various bit profiles as well as cutter types and configurations.

What is claimed is:

1. An earth-boring tool having a body, comprising:

a first recess formed in the body, a portion of the body forming the first recess defining a lateral sidewall surface of a cutting element pocket, at least a portion of the lateral sidewall surface having a generally cylindrical shape centered about a longitudinal axis of the cutting element pocket;

a second recess formed in the body, the second recess having a rotationally leading end adjacent to a rotationally trailing end of the first recess and a rotationally trailing end intersecting a rotationally trailing surface of the body, the second recess being generally centered about the longitudinal axis of the cutting element pocket, at least a portion of the second recess projecting beyond the first recess in a laterally outward direction from the longitudinal axis of the cutting element pocket;

at least one shoulder region at an intersection between the first recess and the second recess; and a filler material disposed within at least a portion of the second recess and abutting against the at least one shoulder region, the filler material defining a rotationally trailing end of the cutting element pocket.

2. The earth-boring tool of claim 1, wherein the body is predominantly comprised of a particle-matrix composite material.

3. The earth-boring tool of claim 1, wherein the filler material substantial fills the second recess.

4. The earth-boring tool of claim 1, further comprising a cutting element secured within the cutting element pocket and wherein a rotationally trailing end of the cutting element abuts a rotationally leading end of the filler material.

5. The earth-boring tool of claim 1, wherein the filler material comprises a preformed solid structure.

6. The earth-boring tool of claim 5, wherein the preformed solid structure is co-sintered to the bit body.

7. The earth-boring tool of claim 5, wherein the preformed solid structure comprises a particle-matrix composite material.

8. An earth-boring tool having a body, comprising:

a first recess formed in the body, a portion of the body forming the first recess defining a lateral sidewall surface of a cutting element pocket, at least a portion of the lateral sidewall surface having a generally cylindrical shape centered about a longitudinal axis of the cutting element pocket;

a second recess formed in the body, the second recess having a rotationally leading end adjacent to a rotationally trailing end of the first recess and a rotationally trailing end positioned within the body and at least partially covered by an outer surface of the body; and a filler material filling at least a portion of the second recess to form at least a portion of a rotationally trailing end of the cutting element pocket.

9. The earth-boring tool of claim 8, wherein the rotationally trailing end of the second recess intersects a rotationally trailing surface of the body.

10. The earth-boring tool of claim 8, wherein the filler material substantial fills the second recess.

11. The earth-boring tool of claim 8, wherein the filler material comprises a preformed solid structure.

12. The earth-boring tool of claim 11, wherein the preformed solid structure is co-sintered to the body.

13. The earth-boring tool of claim 11, wherein the preformed solid structure comprises a particle-matrix composite material.

14. The earth-boring tool of claim 8, wherein the body is predominantly comprised of a particle-matrix composite material.

15. An earth-boring tool having a body, comprising:

a plurality of cutting element pockets, each cutting element pocket of the plurality of cutting element pockets having a longitudinal axis and extending from a rotationally trailing surface of a blade of the earth-boring tool to a rotationally leading surface of the blade, and each cutting element pocket of the plurality of cutting element pockets comprising:

a first recess located proximate to the rotationally leading surface of the blade and formed by a surface of the body having a generally cylindrical shape centered about the longitudinal axis of the cutting element pocket;

a second recess located proximate to the rotationally trailing end of the blade and formed in the body adjacent to the first recess;

at least one discontinuity formed substantially at an interface between a rotationally trailing end of the first recess formed in the body and a rotationally leading end of the second recess formed in the body;

a filler material substantially filling the second recess to form at least a portion of a rotationally trailing end of the cutting element pocket; and a cutting element secured within the cutting element pocket, a rotationally trailing end of the cutting element abutting a rotationally leading end of the filler material.

16. The earth-boring tool of claim 15, wherein the at least one discontinuity comprises a shoulder region.

17. An earth-boring tool having a body, comprising:

a plurality of cutting element pockets, each cutting element pocket of the plurality of cutting element pockets comprising:

a first recess having a longitudinal axis and extending through an outer surface of the body and into a portion of the body;

a second recess having a longitudinal axis and comprising a blind recess formed within the body and located adjacent to the first recess, wherein the longitudinal axis of the first recess and the longitudinal axis of the second recess are oriented at an acute angle;

at least one discontinuity formed substantially at an interface between a rotationally trailing end of the first recess formed in the body and a rotationally leading end of the second recess formed in the body;

a filler material substantially filling the second recess to form at least a portion of a rotationally trailing end of the cutting element pocket; and a cutting element secured within the cutting element pocket, a rotationally trailing end of the cutting element abutting a rotationally leading end of the filler material.

18. The earth-boring tool of claim 17, wherein a portion of the second recess located proximate to an outer surface of the body is at least partially covered by the outer surface of the body.

19. The earth-boring tool of claim 17, wherein each of the first recess and the second recess is formed by a surface of the body having a generally cylindrical shape.

20. The earth-boring tool of claim 17, wherein the cutting element is partially received within a pocket formed in the filler material, the pocket surrounding a rear portion of the cutting element.

* * * * *

UNITED STATES PATENT AND TRADEMARK OFFICE

CERTIFICATE OF CORRECTION

PATENT NO. : 7,836,980 B2
APPLICATION NO. : 11/838008
DATED : November 23, 2010
INVENTOR(S) : John H. Stevens et al.

It is certified that error appears in the above-identified patent and that said Letters Patent is hereby corrected as shown below:

On the title page:

In ITEM (57) ABSTRACT:

| | | |
|---|---|---|
| Line 3 | | change "defining the a back" to --defining a back-- |

In the specification:

| | | |
|---|---|---|
| COLUMN 8, | LINE 32, | change "used to for" to --used to form-- |
| COLUMN 10, | LINE 18, | change "being formed." to --being formed have been developed.-- |
| COLUMN 10, | LINE 49, | change "FIG. **13**B)" to --FIG. **13**C)-- |
| COLUMN 10, | LINE 52, | change "Plug pr filler" to --Plug or filler-- |

In the claims:

| | | | |
|---|---|---|---|
| CLAIM 3, | COLUMN 13, | LINE 11, | change "substantial" to --substantially-- |
| CLAIM 10, | COLUMN 13, | LINE 43, | change "substantial" to --substantially-- |

Signed and Sealed this
Fifteenth Day of November, 2011

David J. Kappos

David J. Kappos
*Director of the United States Patent and Trademark Office*